US005262043A

United States Patent [19]

Boenigk et al.

[11] Patent Number: 5,262,043

[45] Date of Patent: Nov. 16, 1993

[54] COAL TAR PITCH AND THE PREPARATION AND USE THEREOF

[75] Inventors: Winfried Boenigk, Olfen; Hans-Dieter Behrens, Bochum; Hans Spengler, Olfen, all of Fed. Rep. of Germany

[73] Assignee: Rütgerswerke AG, Fed. Rep. of Germany

[21] Appl. No.: 869,936

[22] Filed: Apr. 17, 1992

[30] Foreign Application Priority Data

Apr. 20, 1991 [DE] Fed. Rep. of Germany ..... 4112955

[51] Int. Cl.[5] ..... C10C 3/02; C10C 3/06; C08L 95/00

[52] U.S. Cl. ..... 208/41; 208/44; 106/273.1

[58] Field of Search ..... 208/41, 44; 106/273.1

[56] References Cited

U.S. PATENT DOCUMENTS 2,066,386 1/1937 Bergeim ..... 208/41
5,128,021 7/1992 Romey et al. ..... 208/44

FOREIGN PATENT DOCUMENTS 1236789 2/1988 Canada .
3702720A1 8/1988 Fed. Rep. of Germany .
WO88/05806 8/1988 PCT Int'l Appl. .
616730 2/1949 United Kingdom .

OTHER PUBLICATIONS

Derwent Publications, Ltd. Abstract of SU-A-857 224 (Aug. 23, 1981).
Derwent Publications, Ltd. Abstract of JP-A-54 013 533 (Feb. 1, 1979).

*Primary Examiner*—Theodore Morris
*Assistant Examiner*—Patricia L. Hailey
*Attorney, Agent, or Firm*—Beveridge, DeGrandi, Weilacher & Young

[57] ABSTRACT

An isotropic coal tar pitch having a low content of carcinogenic compounds is prepared by distilling a coal tar pitch in an evaporator having a specific evaporator surface of from 330 to 10,000 $m^2/m^3$, at a temperature in the range of from 300° to 380° C., under a pressure not exceeding 1 mbar, whereby the average stay period is from 2 to 10 minutes. The isotropic pitch thus obtained contains less that 50 ppm of benzo[a]pyrene and is suitable, optionally after adding an oil, resin or other modifying agents having a low benzo[a]pyrene content, for use as binding and impregnating agent and also as protecting agent in construction materials or as varnish (painting agent).

10 Claims, No Drawings

COAL TAR PITCH AND THE PREPARATION AND USE THEREOF

BACKGROUND OF THE INVENTION

The present invention relates to a new coal tar pitch and a process for the preparation and use thereof.

During the distillation of coal tar pitch under normal pressure or in vacuo, a soft pitch or normal pitch is obtained as a residue, from which hard pitch is prepared by further distillation and optionally under introduction of a carrier gas or by working in vacuo. In order to adjust the desired properties, various pitches are admixed with each other or with coal tar fractions.

Coal tar pitches contain substances which can be detrimental to health when used in an improper way. One of the most well-known and most tested compounds occurring in coal tar pitch is the carcinogenic benzo[a]pyrene (3,4-benzpyrene). Legislation which has fully taken into consideration the potential dangerousness of this compound, requires that coal tar pitches having a benzo[a]pyrene content (BAP) above 50 ppm (characterized as dangerous substances) must be handled with appropriate care and attention. The BAP-content of normal pitches amounts to from 10,000 to 14,000 ppm. Hard pitches obtained by oxidation or distillation contain from about 4,000 to 12,000 ppm of BAP.

In order to eliminate the health risks caused by improper use of coal tar pitch, this substance has been replaced in several fields by other materials even though these materials have less advantageous properties. Thus other bituminous distillation residues or resins are used. For example, bitumen is used as coal briquets or stones in road construction or phenol resins are used as binding agents in fireproofing.

On the other hand, when coal is subjected to coking a coal tar is formed which has a normal pitch content of about 50% by weight. It is highly desirable to make use of the good properties and high application potential of such pitch while simultaneously decreasing the health risks for humans who handle this substance.

SUMMARY OF THE INVENTION

An object of the present invention is to prepare a coal tar pitch which has an optical anisotropy below 2%, contains a lower amount of carcinogenic agents, and which has many applications.

According to the present invention, this and other objects are achieved by means of a coal tar pitch containing less than 50 ppm of benzo[a]pyrene.

DETAILED DESCRIPTION OF THE INVENTION

It has been surprisingly found that such pitch can be prepared from a residue of the primary distillation of coal tar by means of distilling this residue in an evaporator at a temperature in the range of from 300° to 380° C., at a pressure below 1 mbar. and a contact period of the residue between 2 and 10 minutes. The evaporator has a specific evaporating surface of from 330 to 10,000 $m^2/m^3$. The contact period is preferably about 5 minutes. 8pray film evaporators, thin layer evaporators and rotating evaporators can be used as evaporators (see EP 0 299 222 A1). Kirk-Othmer Encyclopedia of Chemical Technology, 3rd Edition, Volume 22, pages 564–600 is relied on and incorporated by reference.

It is known from DE 37 02 720 A1 that coal tar pitches having a softening point below 100° C. can be distilled off in a thin layer evaporator, under a pressure not exceeding 10 mbar and at a temperature of 300°–425° C., to yield a pitch which contains a low amount of substances insoluble in quinoline (QI), has a high softening point and a correspondingly high amount of coking residue.

Since the object of the known distillation procedure is that QI should not be formed again (newly formed), the average contact period of the pitch material must be very short. For this reason according to Example 1 the average contact period is less than 1 minute when using the lowest treatment temperature. Similarly low contact periods are used in the other examples.

Although the pitch obtained according to Example 2 shows a high softening point (253° C., Kramer-Sarnow), it contains 140 ppm of benzo[a]pyrene and is therefore a dangerous material. According to this Example, the pressure amounts to 1 mbar and the distillation temperature falls in the interval of from 300° to 380° C. This clearly shows the importance of the contact period in the removal of benzo[a]pyrene.

Further experiments have shown that the use of a distillation temperature below 300° c. does not result in the desired low benzo[a]pyrene content. The use of a distillation temperature above 380° C. can cause re-formation of QI, inhomogeneities in the pitch and hindrances during continuous operation of the distillation apparatus. Even if bubble distillation is performed under a pressure of 100 mbar, a high bottom temperature of 420° C., and the contact period is 60 minutes, the benzo[a]pyrene content of 1% can be reduced only to 4,200 ppm. The pitch thus obtained begins to melt at 116° C. (TMA) at a mesophase content of 3.8%.

Analysis is carried out by using the DIN standards as far as possible:

| | |
|---|---|
| Softening point | DIN 51920 |
| Materials insoluble in toluene (TI) | DIN 51906 |
| Material insoluble in quinoline (QI) | DIN 51921 |
| Coking residue | DIN 51905 |

The optical anisotropy was determined on pieces of pitch embedded in an epoxide resin, after grinding and polishing the surface, by means of a polarization microscope with the aid of a suitable videocamera with automatic picture analysis.

In order to characterize the softening properties of the pitch, the thermomechanical analysis was carried out on a body of pressed pitch powder (diameter 7 mm, height 1.2 mm) with the aid of a Mettler equipment combination (TA3000/TMA40) with a force of 0.05N and by using a heating rate of 5K/min under nitrogen as protective gas. The characteristic temperatures disclosed are defined as follows: the beginning of melting corresponds to a penetration of the penetration sonde of 5 μm; the termination of melting corresponds to a penetration of 1 mm.

Further details of the present invention are shown in the following examples.

EXAMPLES

Example 1

A coal tar pitch ((softening point, Mettler) EPM=89° C., TI=24.1%, QI=5.8%, β-resins=18.3%, coking residue=51.4%, BAP-content=1.1%, beginning of melting (TMA)=36°, termination of melting=62° C.) was distilled off in vacuo at 1 mbar, at a distillations temperature of 300° C., in a thin layer evaporator with an average (medium) stay period of 5 minutes.

The pitch thus obtained is characterized by the following analysis data:

| | |
|---|---|
| TI | 50.5% |
| QI | 10.2% |
| β-resins | 40.3% |
| Coking residue | 83.3% |
| BAP-content | 35 ppm |
| Beginning of melting (TMA) | 156° C. |
| Termination of melting | 194° C. |
| Optical anisotropy | 0.0% |

Example 2

The pitch of Example 1 was distilled off under the conditions described in Example 1 except that the distillation temperature was 340° C.

The pitch thus obtained is characterized by the following analytical data:

| | |
|---|---|
| TI | 62.7% |
| QI | 12.2% |
| β-resins | 50.5% |
| Coking residue | 88.5% |
| BAP-content | 20 ppm |
| Beginning of melt (TMA) | 193° C. |
| Termination of melting | 237° C. |
| Optical anisotropy | 0.0% |

Example 3

The pitch of Example 1 was distilled off under the same conditions as described in the preceding Examples except that the distillation temperature was 380° C.

The pitch thus obtained is characterized by the following analytical data:

| | |
|---|---|
| TI | 70.8% |
| QI | 14.6% |
| β-resins | 56.2% |
| Coking residue | 92.3% |
| Beginning of melting (TMA) | 220° C. |
| Termination of melting | 266° C. |
| Optical anisotropy | 0.0% |

The pitches obtained according to Examples 1-3 can be directly used as a binding agent by adjusting to a suitable mixture temperature. They can also be directly used as impregnating agents for porous structures (e.g., composites). The products of the present invention can be used for all binding/impregnating purposes that conventional pitches can be used for. On pyrolysis the pitches show an isotropic binding coke structure and for this reason the end-products are of a high strength. If direct use cannot be carried out for technical reasons, the viscosity of the pitches of Example 1-3 can be decreased with the aid of compatible oils having a very low BAP-content (BAP-poor oils).

Example 4

72 parts by weight of coal tar pitch of Example 1 were dissolved in 28 parts by weight of anthracene oil (40 ppm benzo[a]pyrene, boiling temperature interval 290°-370° C.) at 200° C. Thus an electrode binding agent was obtained.

The binder pitch thus obtained has the following characteristic properties:

| | |
|---|---|
| EPM | 111.5° C. |
| TI | 38.5% |
| QI | 7.7% |
| β-resins | 30.8% |
| Coking residue | 63.8% |
| BAP-content | 40 ppm |
| Beginning of melting (TMA) | 50° C. |
| Termination of melting (TMA) | 85° C. |
| Optical anisotropy | 0.0% |

The β-resins used in electrode binding agents are generally in the interval between 20 and 25%. The coking residue is higher than expected. Contrary to conventional binding agents prepared from a coal tar pitch having a benzo[a]pyrene content of about 1%, the new pitch of the present invention has an extremely low benzo[a]pyrene content of only 40 ppm.

In a similar way other binding agents (e.g. for making briquettes from coal, for engraving hole stopper masses and fireproof masses and also as impregnating agents) can also be prepared. As oil having a very low benzo[a]-pyrene content, a fraction from the residual oil of the pyrolysis of mineral oil fractions for the preparation of olephines can be used as well.

It is evident that the viscosity of pitches having a high melting point can also be decreased with the aid of oils, resins and bitumen miscible with pitch.

Example 5

92 parts by weight of a commercial product used for bituminous surface protection (Emaillit BV extra of the firm Vedag) were homogenized in a retort with 8 parts of the product according to Example 1 and the mixture was refluxed under stirring. After repeated cooling the product was ready for use. From this new mixture a varnish can be prepared which can be processed as easily as the known products but is more weather-proof.

Example 6

89 parts of Normbitumen (B 200) were heated to 150° C. 11 parts of the pitch according to Example 1, having a fine particle size, were added under stirring. The softening point and penetration thus obtained correspond to the values of normbitumen B 80. The penetration amounts to 77 1/10 mm, the breaking point according to Fraas is −17° C. and the softening point ring and ball is 48° C. Thus the breaking point is up to 7K lower than that of B 80. The results in a broader plasticity margin.

Example 7

60 parts by weight of the coal tar pitch according to Example 1 were dissolved in 25 parts by weight of a coal tar oil (boiling point range 230°-290° C.) and 15 parts by weight of a mixture of toluene and xylene. Thus a fungicidal, rapidly drying paint (varnish) for construction insulation is obtained which is highly resistant to "through-rooting".

Further variations and modifications of the invention will become apparent to those skilled in the art from the foregoing and are intended to be encompassed by the claims appended hereto.

German Priority Application P 41 12 955.5, filed Apr. 20, 1991, is relied on and incorporated by reference.

We claim:

1. A coal tar pitch which has an optical anisotropy below 2% comprising benzo[a]pyrene, wherein the concentration of said benzo[a]pyrene is less than 50 ppm.

2. A process for the preparation of a coal tar pitch according to claim 1, said process comprising distilling coal tar in a first distillation step to produce a residue, distilling said residue of said first distillation step in vacuo not exceeding 1 mbar in an evaporator to obtain said coal tar pitch, wherein the temperature in said evaporator is between 300° C. and 380° C., the contact period of said residue in said evaporator is between 2 and 10 minutes.

3. The process according to claim 2, wherein said contact period is about 5 minutes.

4. A coal tar pitch made by the process of claim 2.

5. The process according to claim 2, said process consisting essentially of distilling coal tar in a first distillation step to produce a residue, distilling said residue of said first distillation step in vacuo not exceeding 1 mbar in an evaporator to obtain said coal tar pitch, wherein the temperature in said evaporator is between 300° C. and 380° C., the contact period of said residue in said evaporator is between 2 and 10 minutes.

6. The process according to claim 2, further comprising recovering said coal tar pitch and admixing said coal tar pitch with a highly aromatic oil having a low benzo[a]pyrene content.

7. A method of using the coal tar pitch according to claim 1, said method comprises using coal tar pitch in the preparation of a paint or varnish by using said coal tar pitch with a paint or varnish.

8. The coat tar pitch according to claim 1, wherein said coal tar pitch is produced by a method comprising distilling coal tar in a first distillation step to produce a residue, distilling said residue of said first distillation step in vacuo not exceeding 1 mbar in an evaporator to obtain said coal tar pitch, wherein the temperature in said evaporator is between 300° C. and 380° C., the contact period of said residue in said evaporator is between 2 and 10 minutes.

9. A coal tar pitch which has an optical anisotropy below 2% wherein said coal tar pitch contains benzo[a]pyrene and wherein the concentration of said benzo[a]pyrene is less than 50 ppm.

10. A coal tar pitch which has an optical anisotropy below 2% comprising benzo[a]pyrene, wherein the concentration of said benzo[a]pyrene is 20 to 40 ppm.

* * * * *